US010105835B1

(12) United States Patent
Kao

(10) Patent No.: US 10,105,835 B1
(45) Date of Patent: Oct. 23, 2018

(54) HAND TOOL HOLDING RACK ASSEMBLY

(71) Applicant: Jui Chien Kao, Taichung (TW)

(72) Inventor: Jui Chien Kao, Taichung (TW)

( * ) Notice: Subject to any disclaimer, the term of this patent is extended or adjusted under 35 U.S.C. 154(b) by 0 days.

(21) Appl. No.: 15/832,226

(22) Filed: Dec. 5, 2017

(51) Int. Cl.
*B25H 3/04* (2006.01)
*A47F 5/08* (2006.01)
*B25H 3/00* (2006.01)

(52) U.S. Cl.
CPC ..... *B25H 3/04* (2013.01); *A47F 5/0853* (2013.01); *B25H 3/003* (2013.01); *B25H 3/006* (2013.01)

(58) Field of Classification Search
CPC ..... B25H 3/04; B25H 3/003; B25H 3/028; B25H 3/06; A47F 5/0853; A47F 5/0846; A47F 7/0028; B25B 13/06; B25B 13/56
USPC ..... 211/70.6
See application file for complete search history.

(56) References Cited

U.S. PATENT DOCUMENTS 5,560,498 A * 10/1996 Porter ..... B60R 9/10 211/20
8,113,352 B1 * 2/2012 Kao ..... B65D 25/107 206/485
8,813,957 B1 * 8/2014 Kao ..... B25H 3/003 206/378
9,126,329 B2 * 9/2015 Kao ..... B25H 3/04
9,205,552 B2 * 12/2015 Kao ..... F16M 13/022
9,452,524 B1 * 9/2016 Kao ..... B25H 3/04
9,522,467 B1 * 12/2016 Kao ..... A47F 7/0028
9,694,491 B1 * 7/2017 Kao ..... B25H 3/04
2011/0186700 A1 * 8/2011 Kao ..... F16M 13/00 248/201
2011/0192810 A1 * 8/2011 Kao ..... B25H 3/028 211/70.6
2015/0034572 A1 * 2/2015 Kao ..... B25H 3/04 211/13.1
2015/0122750 A1 * 5/2015 Kao ..... B25H 3/04 211/13.1
2017/0190047 A1 * 7/2017 Kao ..... B25H 3/04
2017/0274522 A1 * 9/2017 Kao ..... B25H 3/04

* cited by examiner

*Primary Examiner* — Patrick D Hawn
(74) *Attorney, Agent, or Firm* — Ming Chow; Sinorica, LLC

(57) ABSTRACT

A hand tool holding rack assembly has multiple rail bases and two fixing bases. The rail bases are disposed to be parallel with each other, and each rail base has an elongated body and multiple positioning mounts. The positioning mounts are mounted slidably on the elongated body. The two fixing bases are connected with ends of the elongated bodies of the rail bases to connect the rail bases with each other, and each fixing base has at least one fixing slot, multiple fixing tabs, and multiple fixing fasteners. The at least one fixing slot is defined through the fixing base. The fixing tabs are attached respectively to the elongated bodies of the multiple rail bases, and each fixing tab has a threaded hole. The fixing fasteners are mounted through the at least one fixing slot and are screwed respectively with the threaded holes in the fixing tabs.

3 Claims, 7 Drawing Sheets

HAND TOOL HOLDING RACK ASSEMBLY

BACKGROUND OF THE INVENTION

1. Field of the Invention

The present invention relates to a hand tool holding rack assembly, and more particularly to an adjustable hand tool holding rack assembly.

2. Description of Related Art

A conventional hand tool holding rack assembly substantially comprises multiple rail bases and two fixing bases. The two fixing bases are mounted securely on two ends of the rail bases to connect the rail bases together. Each rail base has multiple holding mounts mounted on the rail base to hold hand tools on the rail base.

However, the fixing bases of the conventional holding rack assembly are mounted securely with the rail bases, so the distances between the rail bases are not adjustable. In addition, each positioning mount on the rail bases has a structure in an integral form, so the positioning mounts of the conventional holding rack assembly are not adjustable either. Therefore, the conventional holding rack assembly can only be applied to hold hand tools in specific sizes and forms and is not versatile in use.

To overcome the shortcomings, the present invention tends to provide a hand tool holding rack assembly to mitigate or obviate the aforementioned problems.

SUMMARY OF THE INVENTION

The main objective of the invention is to provide a hand tool holding rack assembly that is adjustable to hold different tools in different sizes and forms and is versatile in use.

The hand tool holding rack assembly has multiple rail bases and two fixing bases. The rail bases are disposed to be parallel with each other, and each rail base has an elongated body and multiple positioning mounts. The positioning mounts are mounted slidably on the elongated body. The two fixing bases are connected with ends of the elongated bodies of the rail bases to connect the rail bases with each other, and each fixing base has at least one fixing slot, multiple fixing tabs, and multiple fixing fasteners. The at least one fixing slot is defined through the fixing base. The fixing tabs are attached respectively to the elongated bodies of the multiple rail bases, and each fixing tab has a threaded hole. The fixing fasteners are mounted through the at least one fixing slot and are screwed respectively with the threaded holes in the fixing tabs.

Other objects, advantages and novel features of the invention will become more apparent from the following detailed description when taken in conjunction with the accompanying drawings.

DETAILED DESCRIPTION OF PREFERRED EMBODIMENT

Figure 1:
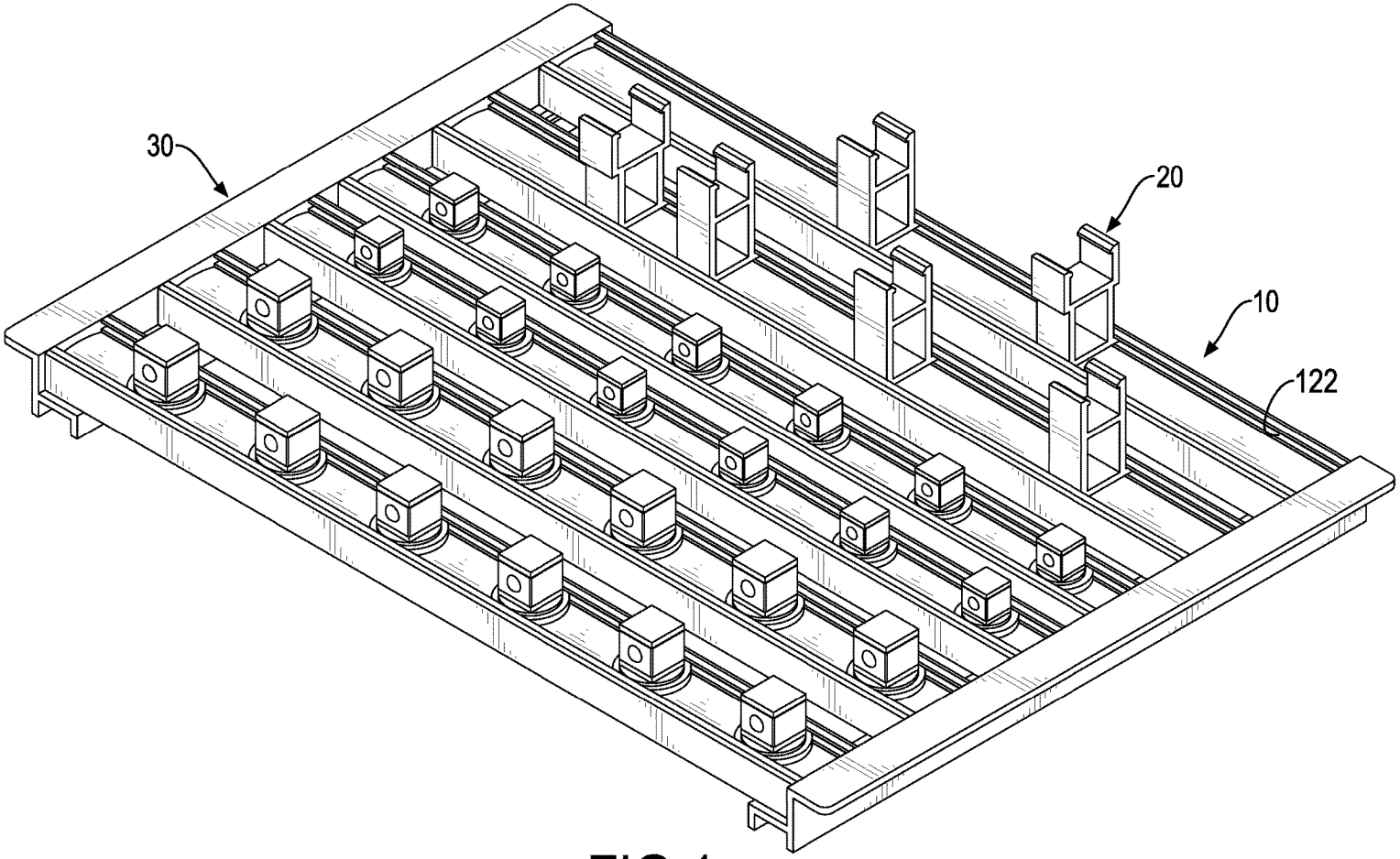
FIG. 1 is a perspective view of a hand tool holding rack assembly in accordance with the present invention.
Figure 2:
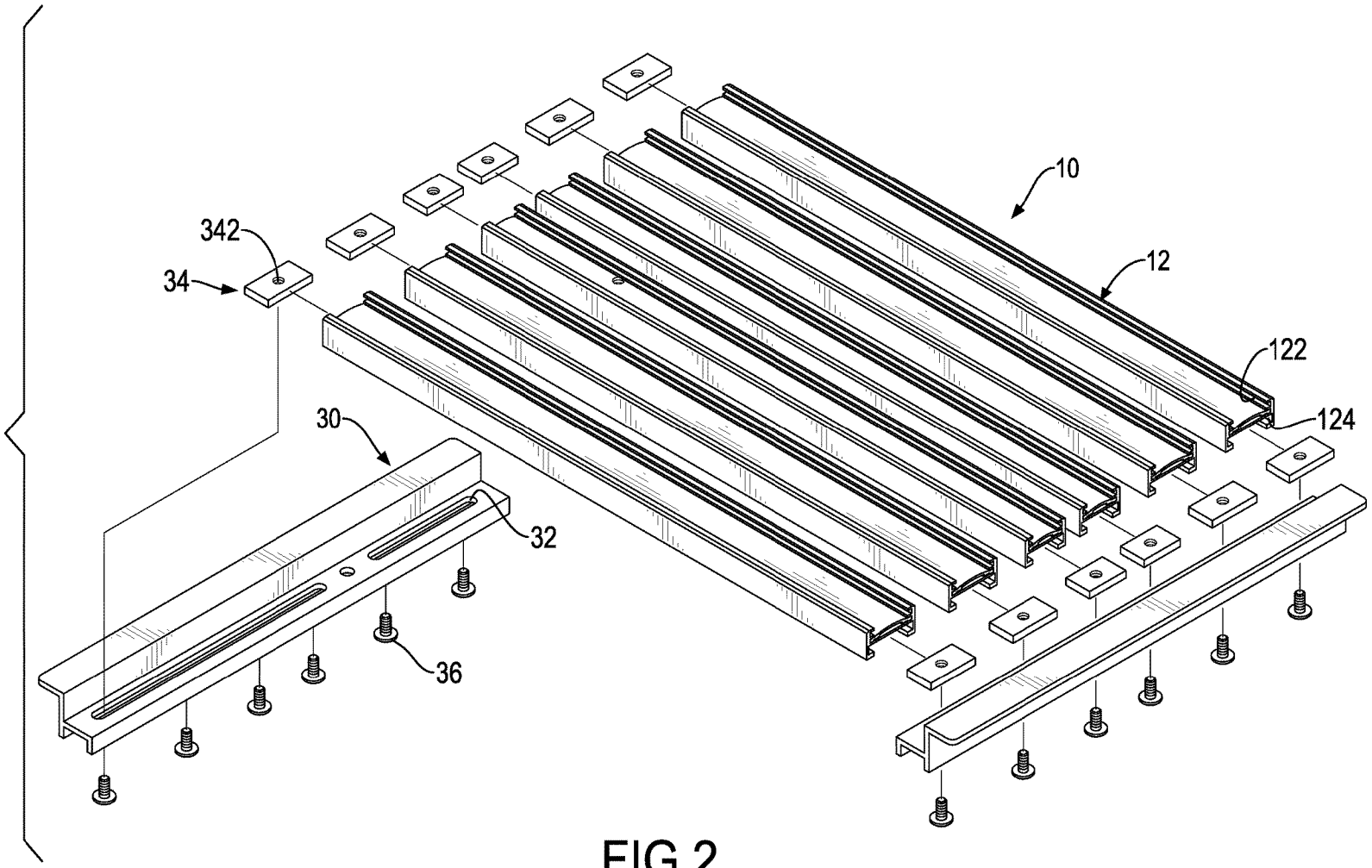
FIG. 2 is an exploded perspective view of the rail base holding rack assembly and two fixing bases of the holding rack assembly in FIG. 1.

With reference to FIGS. 1 and 2, a hand tool holding rack assembly in accordance with the present invention comprises multiple rail bases 10 and two fixing bases 30.

The rail bases 10 are disposed to be parallel with each other, and each rail base 10 comprises an elongated body 12 and multiple positioning mounts 20 mounted slidably on the body 12. The body 12 has a rail channel 122 formed in a top segment of the body 12 and extends along the body 12, and the multiple positioning mounts 20 are mounted slidably in the rail channel 122. The body 12 further has a fixing channel 124 defined in a bottom portion of the body 12, may extend along the body 12, and is located below the rail channel 122.

The fixing bases 30 are mounted respectively with ends of the rail bases 10 to connect the rail bases 10 with each other. Each fixing base 30 is connected with corresponding ends of the bodies 12 of the rail bases 10 and has at least one fixing slot 32, multiple fixing tabs 34, and multiple fixing fasteners 36. The at least one fixing slot 32 is defined through the fixing base 30. Preferably, two fixing slots 32 are implemented in each fixing base 30. In addition, the fixing slots 32 in one of the fixing bases 30 are parallel with the fixing slots 32 in the other fixing base 30. Each fixing tab 34 is mounted in an end of the fixing channel 124 of one of the rail bases 10 and has a threaded hole 342. The fixing fasteners 36 are mounted through the at least one fixing slot 32 and are screwed respectively with the threaded holes 342 in the fixing tabs 34 to connect the fixing base 30 with the rail bases 10.

Figure 3:
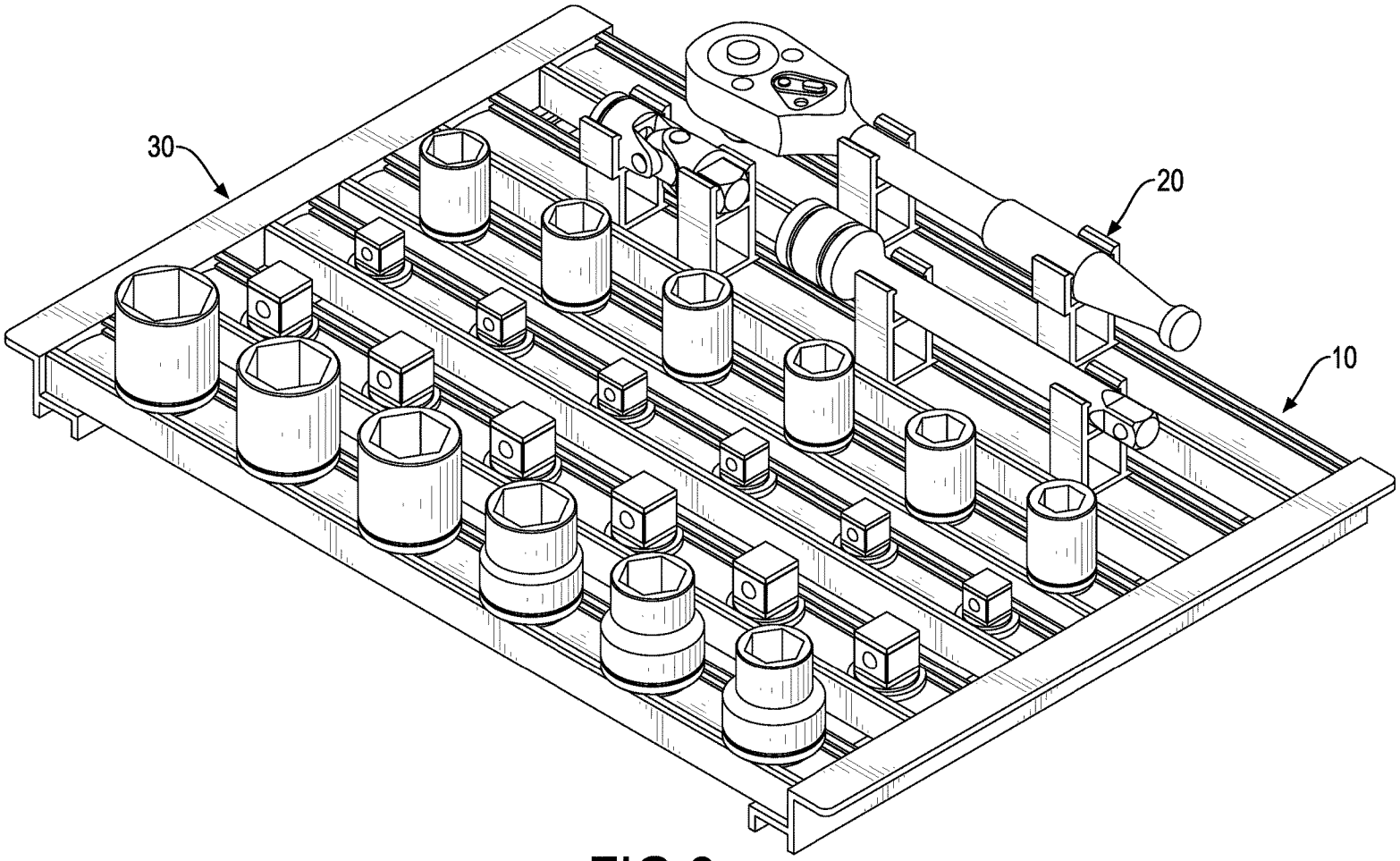
FIG. 3 is an operational perspective view of the holding rack assembly in FIG. 1.

With such an arrangement, the rail bases 10 are connected with each other and are disposed to be parallel with each other by the fixing bases 30. With further reference to FIG. 3, hand tools, such as wrenches, screwdrivers, or wrench sockets can be held on the positioning mounts 20 of the rail bases 10. When the corresponding fixing fatteners 36 connected with one of the rail bases 10 are released from the threaded holes 342 in the corresponding fixing tabs 34, the rail base 10 can be moved relative to the fixing bases 20 along the fixing slots 32. Consequently, the distances between the adjacent two rail bases 10 can be adjusted, such that the holding rack assembly in accordance with the present invention can be applied to hold different tools in different sizes or forms and is versatile in use.

Figure 4:
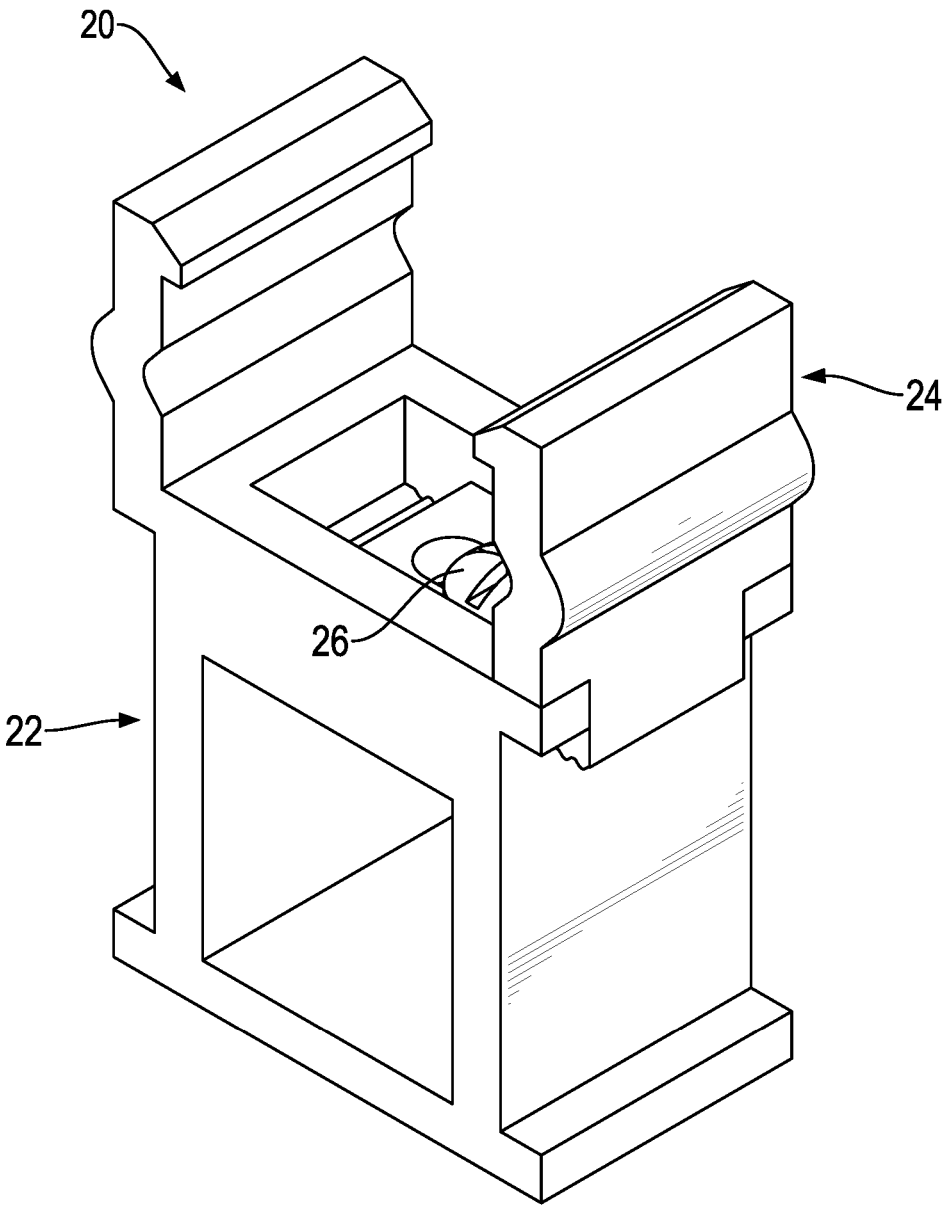
FIG. 4 is an enlarged perspective view of an embodiment of a positioning mount of the holding rack assembly in FIG. 1.
Figure 5:
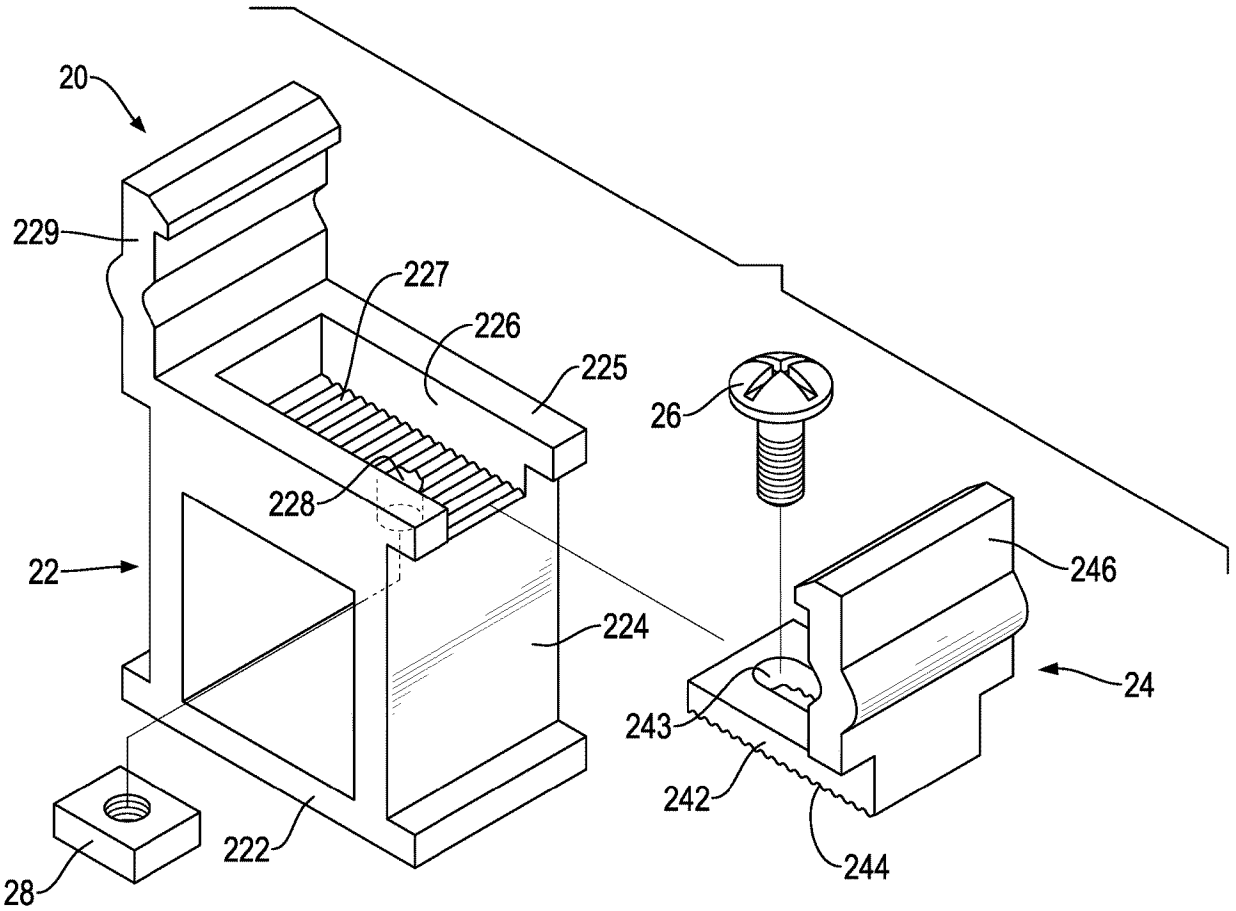
FIG. 5 is an exploded perspective view of the positioning mount in FIG. 4.

With reference to FIGS. 1, 4 and 5, an embodiment of a positioning mount 20 comprises a sliding base 22, a clamping base 24, an adjusting fastener 26, and a nut 28. The sliding base 22 is mounted slidably in the rail channel 122 of a corresponding one of the rail bases 10 and comprises a bottom panel 222, two supporting side walls 224, a top supporting base 225, and a clamping arm 229. The bottom panel 222 may be rectangular in shape and is mounted slidably in the rail channel 122 in the corresponding rail base 10. The supporting side walls 224 are formed on and protrude from a top of the bottom panel 222 and are parallel with each other. The top supporting base 225 is formed on top ends of the two supporting side walls 224 and has an elongated adjusting recess 226 defined in a top of the top supporting base 225. The adjusting recess 226 has multiple positioning teeth 227 formed on a bottom of the adjusting recess 226 and a through hole 228 defined through the bottom of the adjusting recess 226. The adjusting recess 226 further has an opening defined in an end of the top supporting base 225 and communicating with the adjusting recess 226. The clamping arm 229 is formed on and protrudes form an end of the top supporting base 225 opposite the opening of the adjusting recess 226.

The clamping base 24 is mounted in the adjusting recess 226 in the sliding base 22 and comprises a bottom board 242 and a clamping arm 246. The bottom board 242 is mounted in the adjusting recess 226 in the sliding base 22 and has an elongated hole 243 defined through the bottom board 242 and multiple positioning teeth 244 formed on a bottom of the bottom board 242 and selectively engaged with the positioning teeth 227 on the sliding base 22. The clamping arm 246 is formed on and protrudes from an end of the bottom board 242. The adjusting fastener 26 is mounted through the elongated hole 243 in the clamping base 24 and the through hole 228 in the sliding base 22 and is screwed with the nut 28 to connect the clamping base 24 securely with the sliding base 22.

Figure 6:
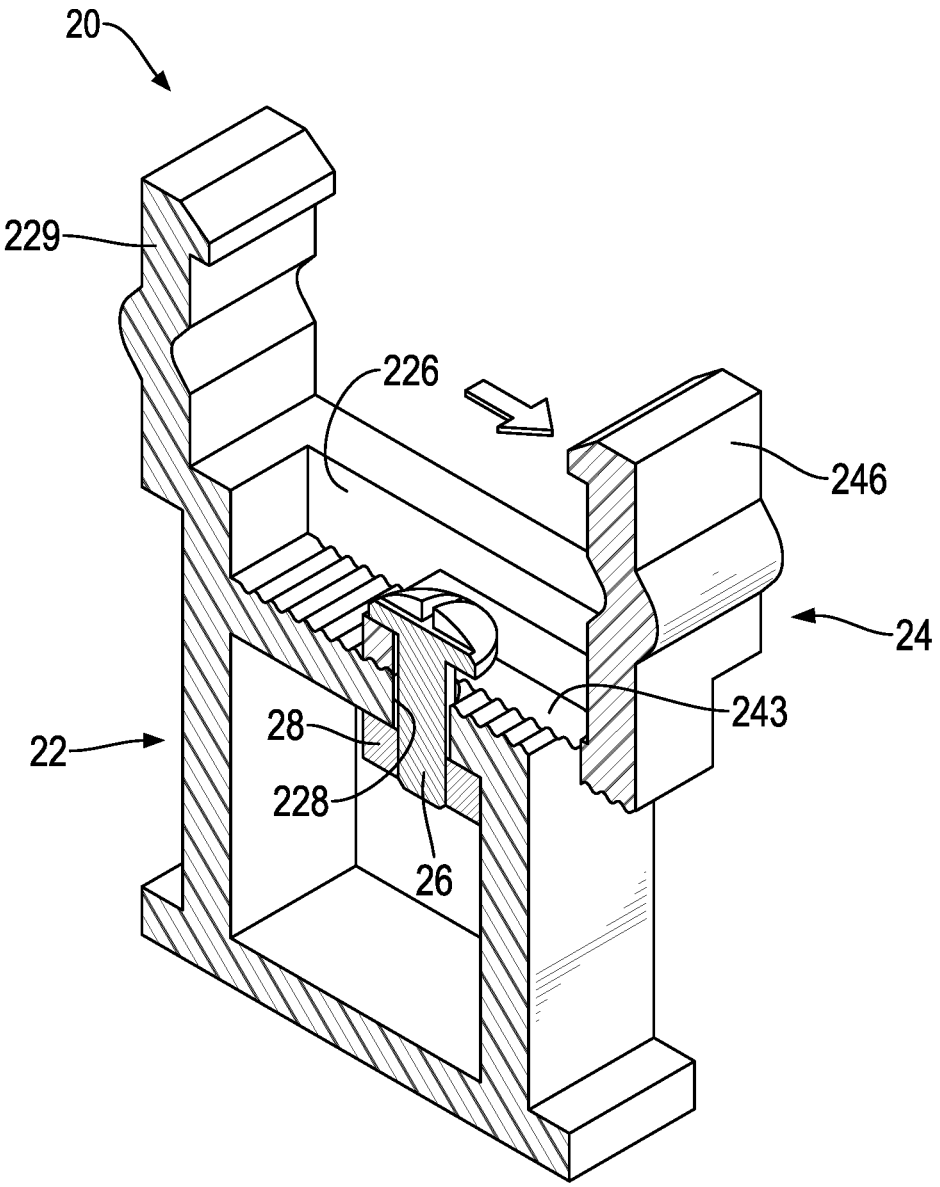
FIG. 6 is an operational perspective view in partial section of the positioning mount in FIG. 4.
Figure 7:
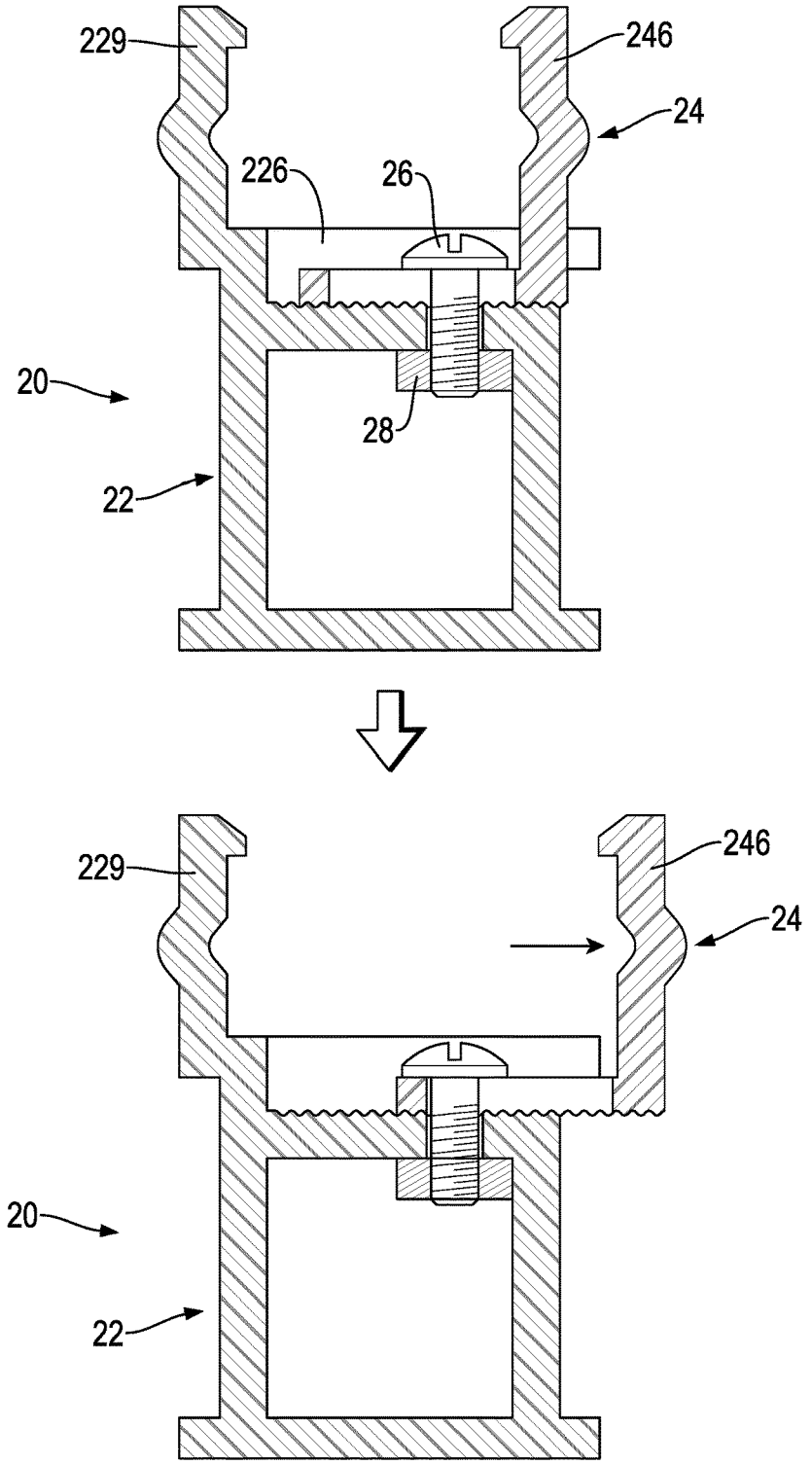
FIG. 7 shows operational side views in partial section of the positioning mount in FIG. 4.

With such a positioning mount, a tool, such as a wrench or a screwdriver, can be clamped between the clamping arms 229, 246 of the sliding base 22 and the clamping base 24. With reference to FIGS. 6 and 7, when the adjusting fastener 26 is released from the nut 28, the clamping base 24 can be moved relative to the sliding base 22 along the elongated adjusting recess 226 to adjust the distance between the clamping arms 229, 246. With the change of the distance between the clamping arms 229. 246, the positioning mount 20 can be applied to hold a different tool in a different size or form, and the positioning mount is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hand tool holding rack assembly comprising:
- multiple rail bases disposed to be parallel with each other, and each rail base comprising:
  - an elongated body; and
  - multiple positioning mounts mounted slidably on the elongated body; and
- two fixing bases connected with ends of the elongated bodies of the rail bases to connect the rail bases with each other, and each fixing base comprising
  - at least one fixing slot defined through the fixing base;
  - multiple fixing tabs attached respectively to the elongated bodies of the multiple rail bases, and each fixing tab having a threaded hole;
  - multiple fixing fasteners mounted through the at least one fixing slot and screwed respectively with the threaded holes in the fixing tabs; and
  - a rail channel defined in a top segment of the elongated body and extending along the elongated body of the rail base, wherein one of the positioning mounts of one of the rail bases comprises
- a sliding base mounted slidably in the rail channel of the rail base and comprising
  - a bottom panel mounted slidably in the rail channel in the rail base;
  - two supporting side walls formed on and protruding from a top of the bottom panel and being parallel with each other;
  - a top supporting base formed on top ends of the two supporting side walls and having
    - an elongated adjusting recess defined in a top of the top supporting base and having
      - multiple positioning teeth formed on a bottom of the adjusting recess;
      - a through hole defined through the bottom of the adjusting recess; and
      - an opening defined in an end of the top supporting base and communicating with the adjusting recess;
  - a clamping arm formed on and protruding form an end of the top supporting base opposite the opening of the adjusting recess;
- a clamping base mounted in the adjusting recess in the sliding base and comprising
  - a bottom board mounted in the adjusting recess in the sliding base and having
  - an elongated hole defined through the bottom board; and
  - multiple positioning teeth formed on a bottom of the bottom board; and
  - a clamping arm formed on and protruding from an end of the bottom board; and
- an adjusting fastener mounted through the elongated hole in the clamping base and the through hole in the sliding base; and
- a nut screwed with the adjusting fastener.

2. The hand tool holding rack assembly as claimed in claim 1, wherein
- each rail base comprises
  - a fixing channel defined in a bottom portion of the elongated body of the rail base and located below the rail channel of the rail base; and
- each fixing tab of each fixing base is mounted in an end of the fixing channel in a corresponding one of the rail bases.

3. A positioning mount for a hand tool holding rack assembly comprising
- a sliding base comprising
  - a bottom panel;
  - two supporting side walls formed on and protruding from a top of the bottom panel and being parallel with each other;
  - a top supporting base formed on top ends of the two supporting side walls and having
    - an elongated adjusting recess defined in a top of the top supporting base and having
      - multiple positioning teeth formed on a bottom of the adjusting recess;
      - a through hole defined through the bottom of the adjusting recess; and
      - an opening defined in an end of the top supporting base and communicating with the adjusting recess;
  - a clamping arm formed on and protruding form an end of the top supporting base opposite the opening of the adjusting recess;
- a clamping base mounted in the adjusting recess in the sliding base and comprising a bottom board mounted in the adjusting recess in the sliding base and having an elongated hole defined through the bottom board; and multiple positioning teeth formed on a bottom of the bottom board; and a clamping arm formed on and protruding from an end of the bottom board; and an adjusting fastener mounted through the elongated hole in the clamping base and the through hole in the sliding base; and a nut screwed with the adjusting fastener.

* * * * *